US005087903A

United States Patent [19]

Chiu

[11] Patent Number: 5,087,903

[45] Date of Patent: Feb. 11, 1992

[54] SEESAW TYPE MECHANICALLY INTERLOCKED ELECTROMAGNETIC SWITCH FOR CONTROLLING FORWARD/REVERSE CURRENT SYSTEMS

[76] Inventor: Han-Tsung Chiu, No. 33, Lane 145, Fu-Ying Road, Hsin-Chuang, Taipei Hsien, Taiwan

[21] Appl. No.: 530,325

[22] Filed: May 30, 1990

[51] Int. Cl.[5] ..... H01H 67/02

[52] U.S. Cl. ..... 335/128; 335/177; 335/80

[58] Field of Search ..... 335/78–85, 335/124, 125, 126, 128, 177, 178, 182, 14 183

[56] References Cited

U.S. PATENT DOCUMENTS 4,286,244 8/1981 Schuessler et al. ..... 335/230
4,366,459 12/1982 Vitola ..... 335/78
4,496,919 1/1985 Fournier et al. ..... 335/5

*Primary Examiner*—Gerald P. Tolin
*Assistant Examiner*—Lincoln Donovan
*Attorney, Agent, or Firm*—Bacon & Thomas

[57] ABSTRACT

A seesaw electromagnetic switch for controlling a chain/forward/reverse current system includes a seesaw assembly and an exciter set. Springs are provided and disposed between the seesaw assembly and the exciter set to balance the seesaw assembly. Because of this balanced position, even if two coils parallelly disposed in the exciter set are incidently provided with current at the same time and thereby cause the seesaw assembly to swing, no current will flow through the main circuit and no short-circuit will occur in either the forward rotation circuit or the reverse rotation circuit, protecting the motor in use from burning out. The wiring is simplified and the volume of the electromagnetic switch is reduced by the closely and parallelly disposed coils of the exciter set, by the multiple terminals provided on top of an upper casing of the switch, and by the double-wall structure of the main casing of the switch which allows conductors to pass through side openings and a bottom space formed between the two walls of the main casing, connecting contacts at two opposite sides of the switch to form the forward circuit and the reverse circuit.

4 Claims, 10 Drawing Sheets

SEESAW TYPE MECHANICALLY INTERLOCKED ELECTROMAGNETIC SWITCH FOR CONTROLLING FORWARD/REVERSE CURRENT SYSTEMS

BACKGROUND OF THE INVENTION

It is known that failures, complicated wiring, and frequent errors are often found in conventional mechanical type forward/reverse current electromagnetic switches for forward/reverse rotation motors. Such failures result in embarrasing situations in which motor becomes inoperable in the field when it is urgently needed. Before technicians come to the site to repair the motor, users can do nothing but complain.

There is one type of forward/reverse current electromagnetic switch presently common in the market, the "Integrally constructed forward/reverse current electromagnetic contactor" described in file number 74205969, filed in the to Taiwan Patent Office on Jul. 20, 1985, and published in the Taiwan Patent Gazette dated Jan. 1, 1986. However, this type of forward-/reverse current electromagnetic contactor has the following disadvantages:

(1) As shown in FIG. 9, an analytical drawing of the mechanism of the electromagnetic contactor, the entire mechanism is floatable within a fixed base-plate without fixed location; similarly, its movable contact point member a is also floatable within and above the base-plate and there is a considerable gap between the movable contact point member and the base-plate. When a fixed iron core is excited by a coil and becomes capable of attracting a movable iron core C, one end of the movable contact point member a is downwardly pulled by a link B and causes the movable connect point member a to swing with a spring D as its pivot so that the contact point on the movable connect point member a may contact a fixed contact point. In the event the attractive force F comes from the left-hand side as shown in FIG. 9, the movable connect point member a is turned with the left-hand instantaneous center 01 as its fulcrum. Conversely, when the attractive force F comes from the right-hand side, the movable contact point member a is turned with the left-hand instantaneous center 02 as its pivot. Because there is no fixed center for the entire mechanism, because the structure of the contactor itself can not provide fixed contact points located in the same plane, and because the movable contact point member a is moved by different attractive forces F which are generated whenever there are currents of different voltages and amperes passing the coil, swinging of the contact point member a with a different fulcrum causes the contact point to contact different places, resulting frequently in poor contact of the contact point and causing the motor to run with a single wire and finally be burnt out or become inoperable.

(2) As the mentioned above since the entire mechanism of the electromagnetic contactor is floatable, when the contactor has been used for a period of time, or is used for a larger capacity motor to generate larger current to pass through the contact point, either contact point of the movable contact point member a is likely to become stuck to the fixed contact point and be retained at the position of 02 as shown in FIG. 9. If another reverse current push-button switch is pressed at this point, so that another coil excites the fixed iron core to cause the contact point of the movable contact point member a to contact the fixed contact point, then a short-circuit will occur and the electromagnetic contactor will burn out. In a less serious situation, in which the electromagnetic contactor for controlling a motor is installed in a control box, other electrically-controllled components may also be damaged by such a burn out, which not only stops operation of the machine itself but also could affect the running of a whole plant. In a much more serious situation, in which the electromagnetic contactor is used for a motor operator of a rolling shutter which is installed in a combustible environment, such as in and above an interior ceiling, a fire might occur and cause death and injury of persons and other serious physical damage and losses.

It therefore has been an objective of the inventor to provide a seesaw type mechanically interlocked electromagnetic switch for controlling forward/reverse current system which eliminates the disadvantages exhibited by in the prior art systems.

SUMMARY OF THE INVENTION

The present invention relates to a mechanically interlocked type forward/reverse current electromagnetic switch which includes a seesaw assembly and an exciter set. This electromagnetic switch is characterized by springs disposed at two ends of the seesaw assembly between the seesaw assembly and the exciter set so that the seesaw assembly may maintain a balanced condition; by a double-wall main easing which allows conductors to pass through a space between the walls and constitute "forward" and a "reverse" circuits; by a pair of coils which form a part of the exciter set and are closely arranged in parallel to largely reduce the height and the overall volume of the electromagnetic switch; and by an upper casing on which a plurality of terminals may be provided to simplify the wiring procedure of the electromagnetic switch. The inventive seesaw type mechanically interlocked electromagnetic switch for controlling forward/reverse current system is a light, thin, short, and compact product with multiple functions.

Other characteristics as well as the detailed structure and the best benefits of the present invention may be further understood through the following detailed description with reference to the accompanying drawings.

DETAILED DESCRIPTION OF THE PREFERRED EMBODIMENTS

Figure 1:
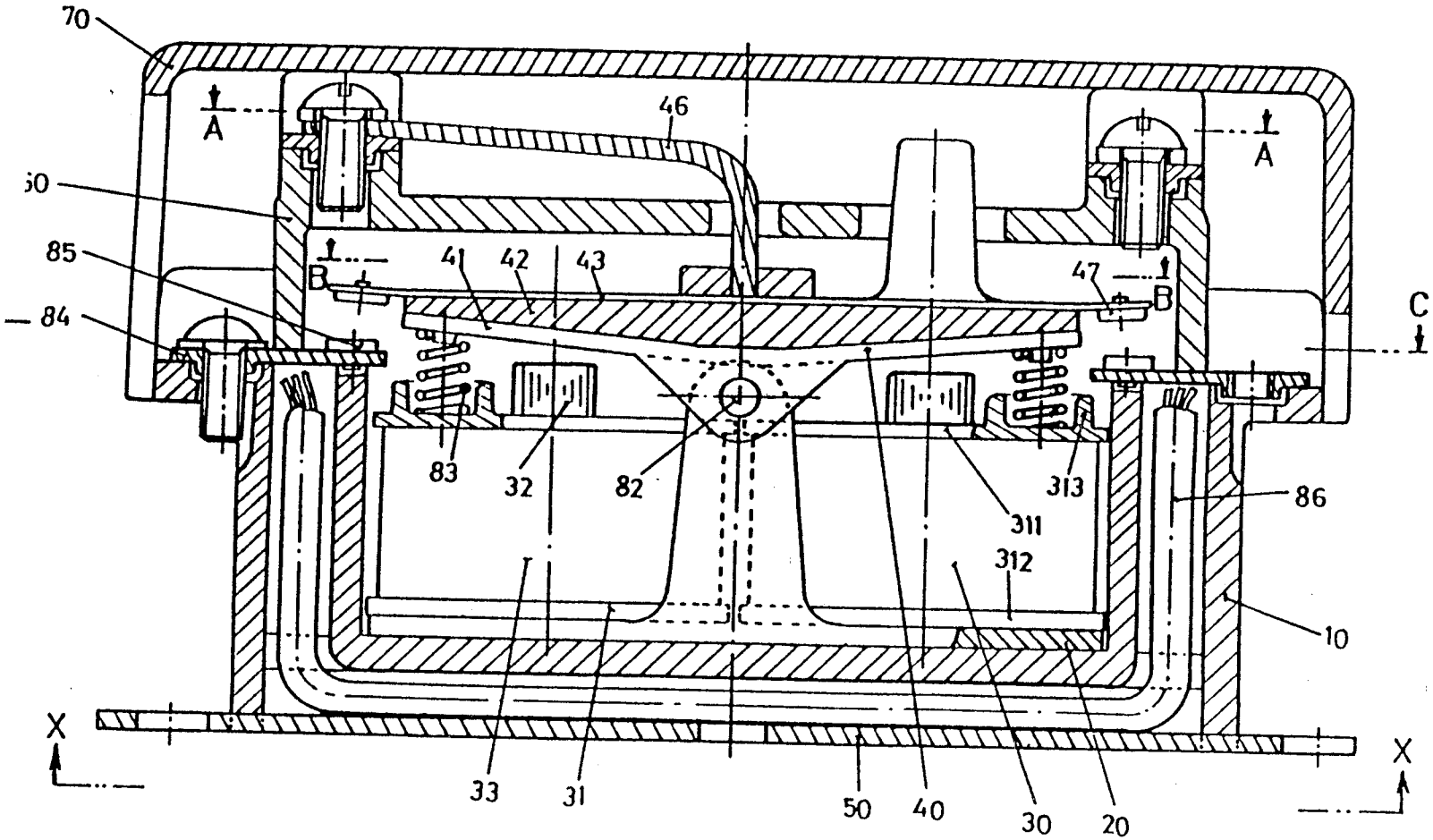
FIG. 1 is a vertical cross section view showing the assembly of the present invention.
Figure 2:
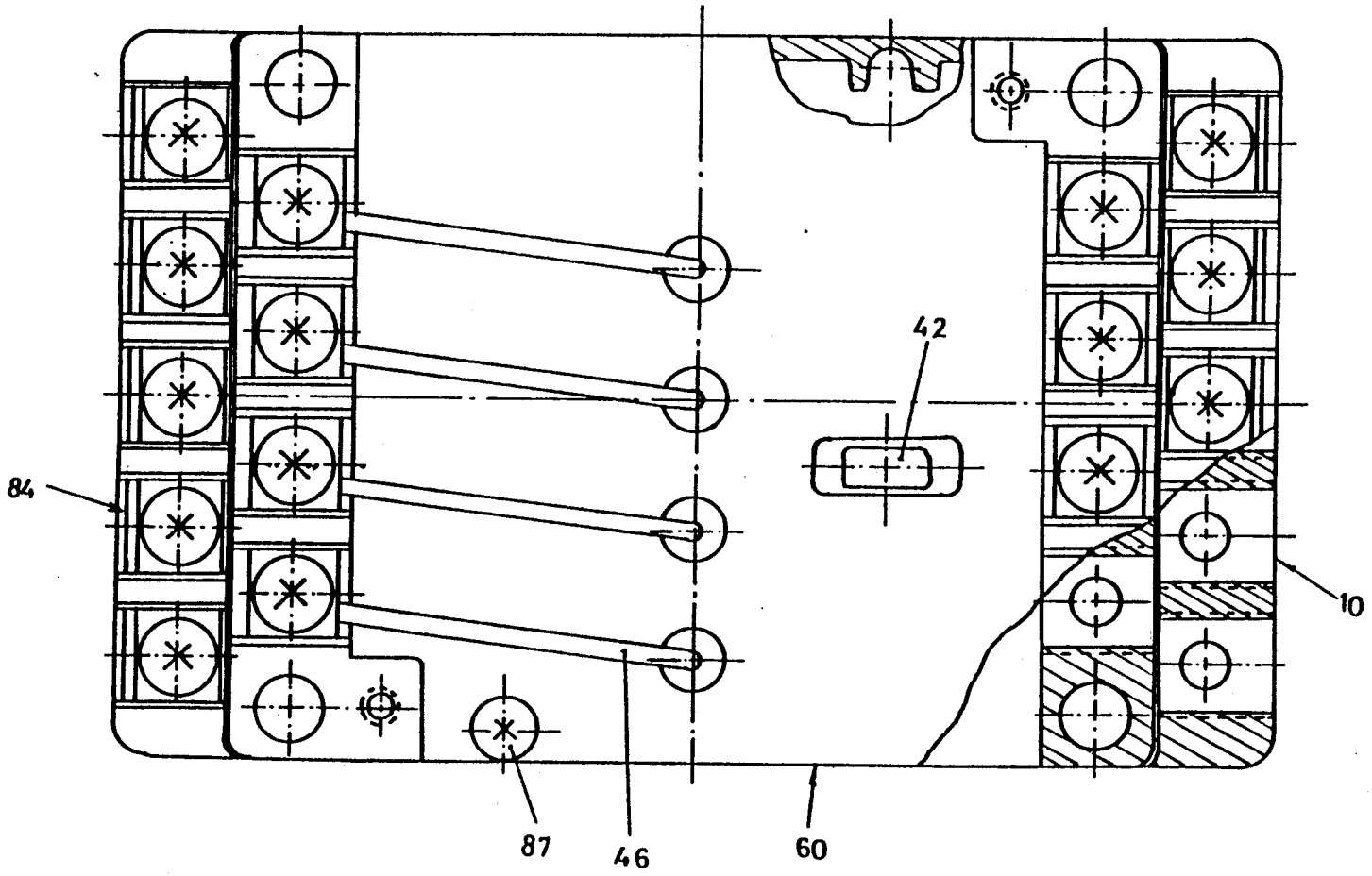
FIG. 2 is a top plan view taken along line A—A of FIG. 1

Referring to FIGS. 1-6 the present invention includes a main casing 10, a U-shaped seat 20, and exciter set 30, a seesaw assembly 40, a sloeplate 50, an upper casing 60, and other connecting parts, which include screws 81, a pivot 82, a springs 83, a fixed strip of conductors 84, a fixed contact points 85, switch conductors 86 and screws 87. The main casing 10 has double walls, the U-shaped seat 20 being positioned in an inner casing 101 formed by the inner wall of main casing 10. The exciter set 30 is then fixedly positioned within the U-shaped seat 20. Fastening holes 102 are provided on the inner casing 101 of the main casing 10 corresponding to threaded holes formed on the bottom of the U-shaped seat 20 for screws 81 to screw therethrough and fasten the inner casing 101 and the U-shaped seat 20 together. The exciter set 30 further includes two coil holders 31, two fixed iron cores 32, and two coils 33. The fixed iron cores 32 are separately received through openings formed in the center of the coil holders 31 with their upper ends slightly projecting out of an upper flange 311 of each coil holder 31 and with their bottom ends being fixed to the bottom of the U-shaped seat 20. The coils 33 are separately disposed in the coil holders 31 between the upper flanges 311 and lower flanges 312 of the coil holders 31. At proper positions on two parallel sides of the U-shaped seat 20, each is formed with a round hole for a fixed pivot 82 to pass through with the seesaw assembly 40 being supported on the pivot 82 and freely swingable thereon. Two springs 83 are separately disposed near two ends of the seesaw assembly 40 between the seesaw assembly and the exciter set 30. One end of the springs 83 is fixed in a spring seat 313 formed on top of each out of coil holders 31 so that the spring 83 will not be disloccated when it is compressed, and another end of spring 83 is detachably attached to a seesaw 41 of the seesaw assembly 40 which is usually maintained in a balanced position by the two springs 83.

The seesaw assembly 40 further includes, an insulation seat 42, a plurality of elastic strip conductors 43, an elastic strip conductor 44, an elastic strip conductor 45, a plurality of flexible conductors 46, and a plurality of contact points 47. The seesaw 41 is connected to the bottom of the insulation seat 42, whereas the elastic strip conductors 43 are separately disposed in the to grooves formed on the insulation seat 42 and centrally fixed by a projected edge of the insulation seat 42.

Figure 3:
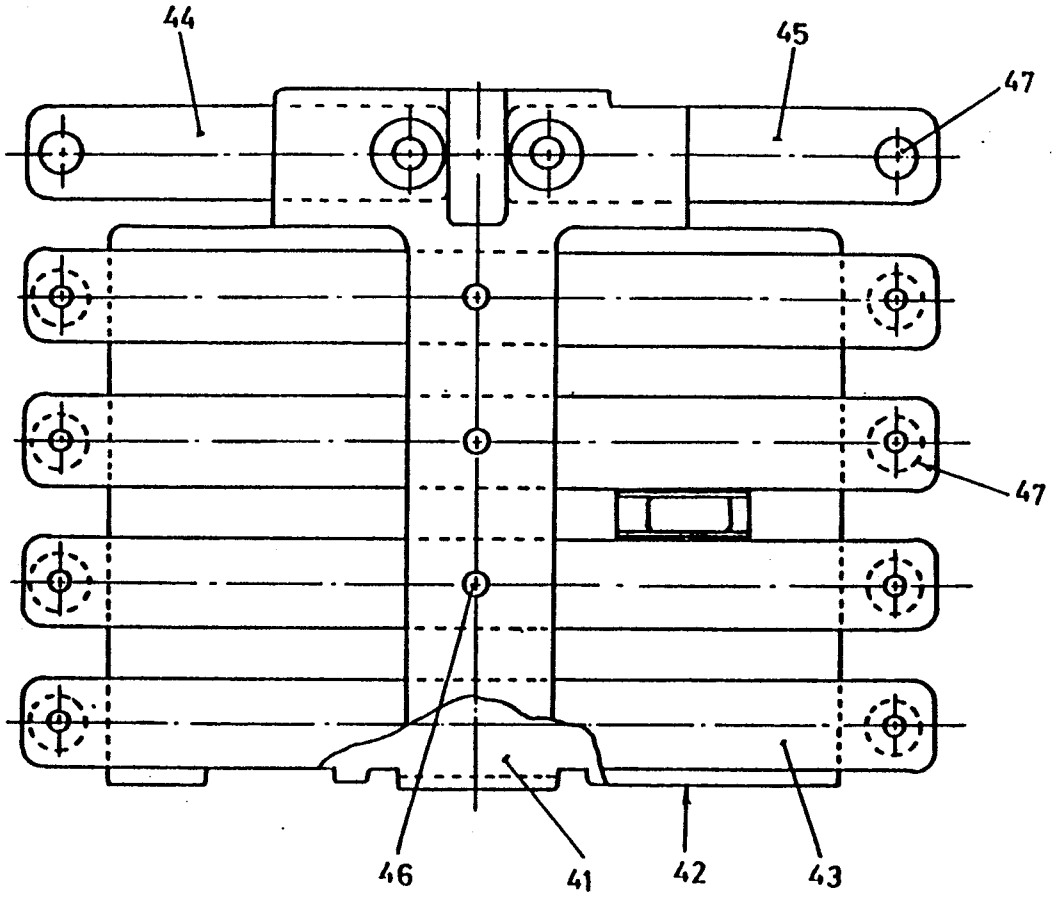
FIG. 3 is a top plan view taken along line B—B of FIG. 1
Figure 4:
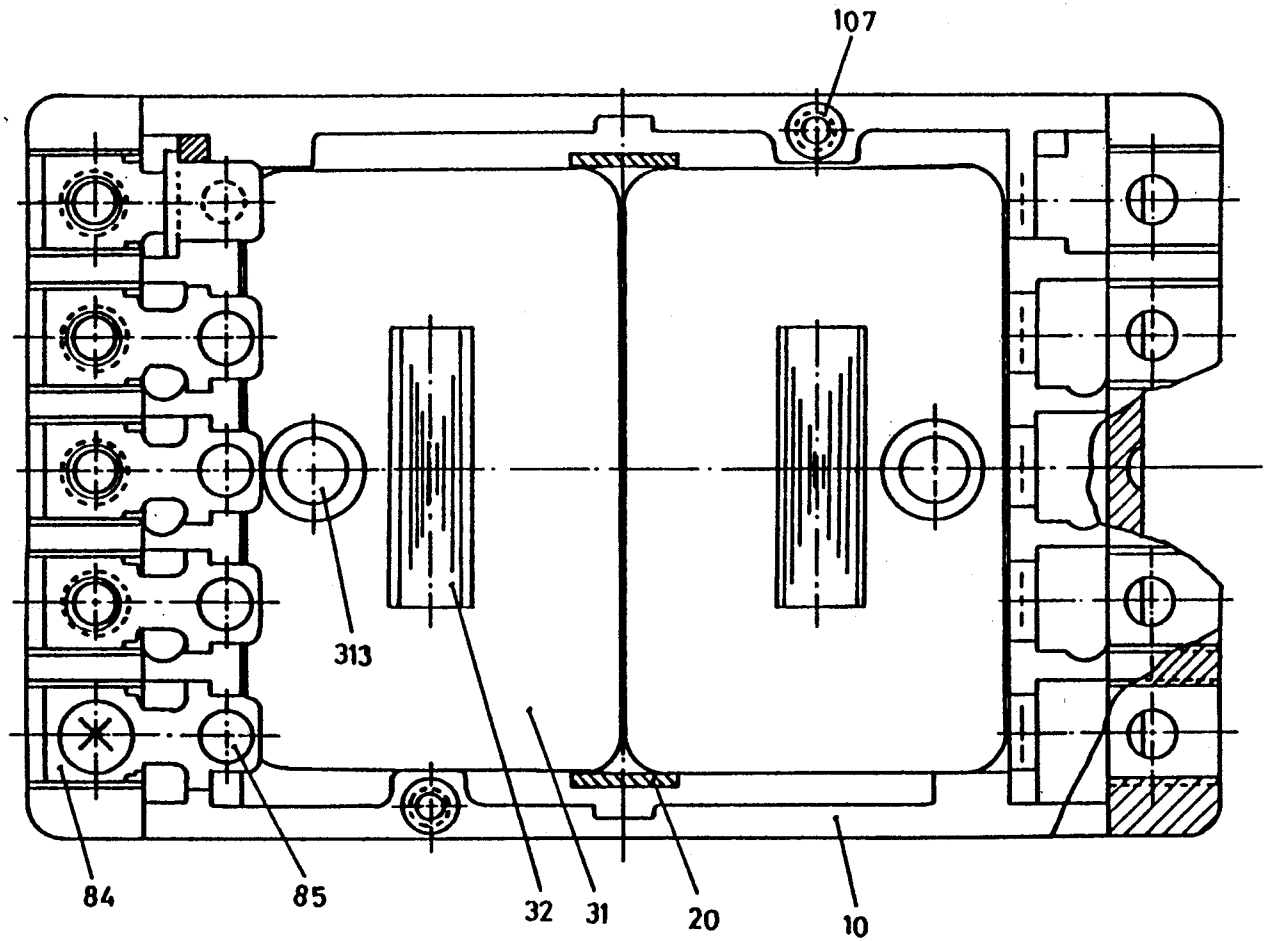
FIG. 4 is a top plan view taken along line C—C of FIG. 1
Figure 5:
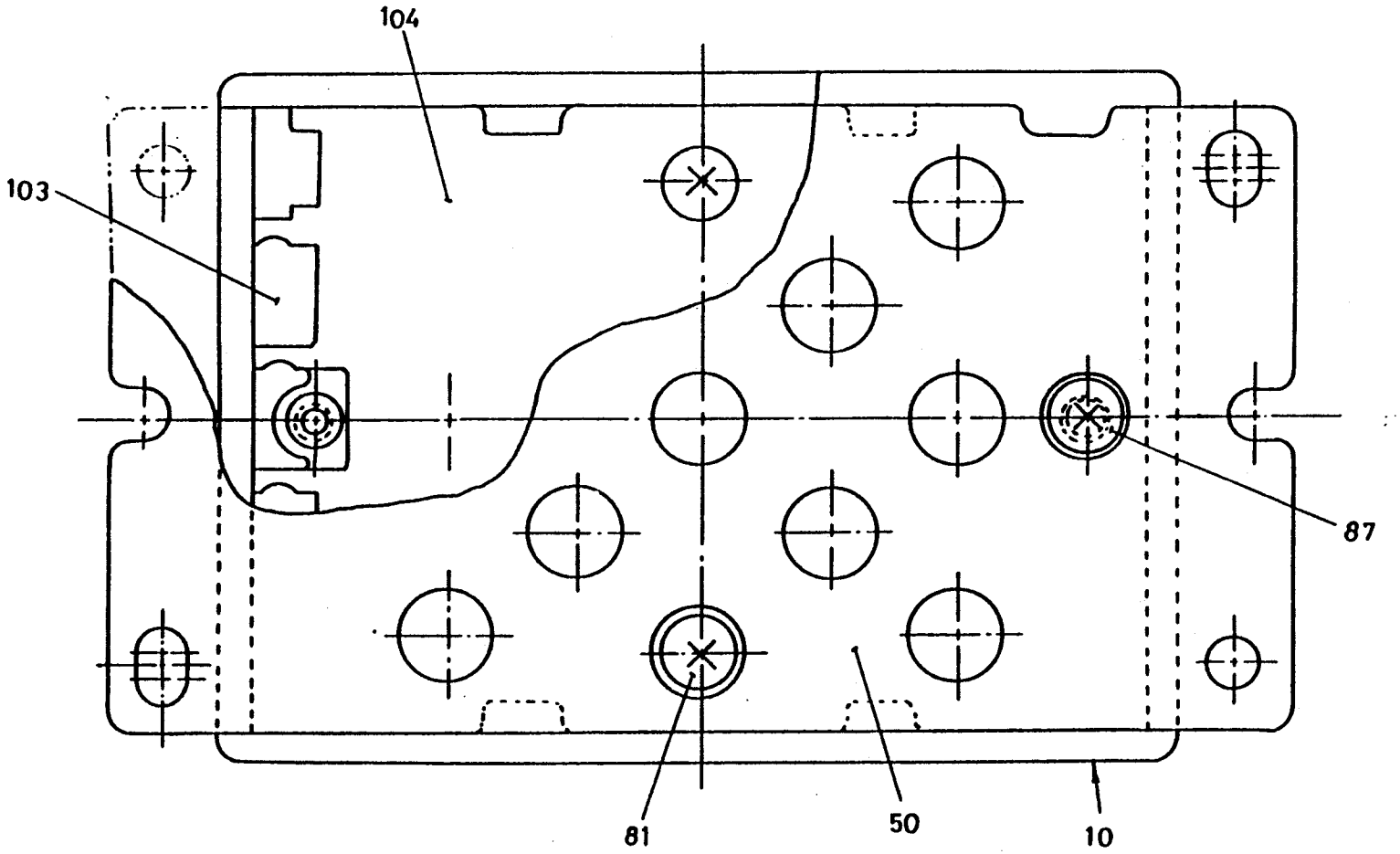
FIG. 5 is a bottom view taken along line X—X of FIG. 1
Figure 6:
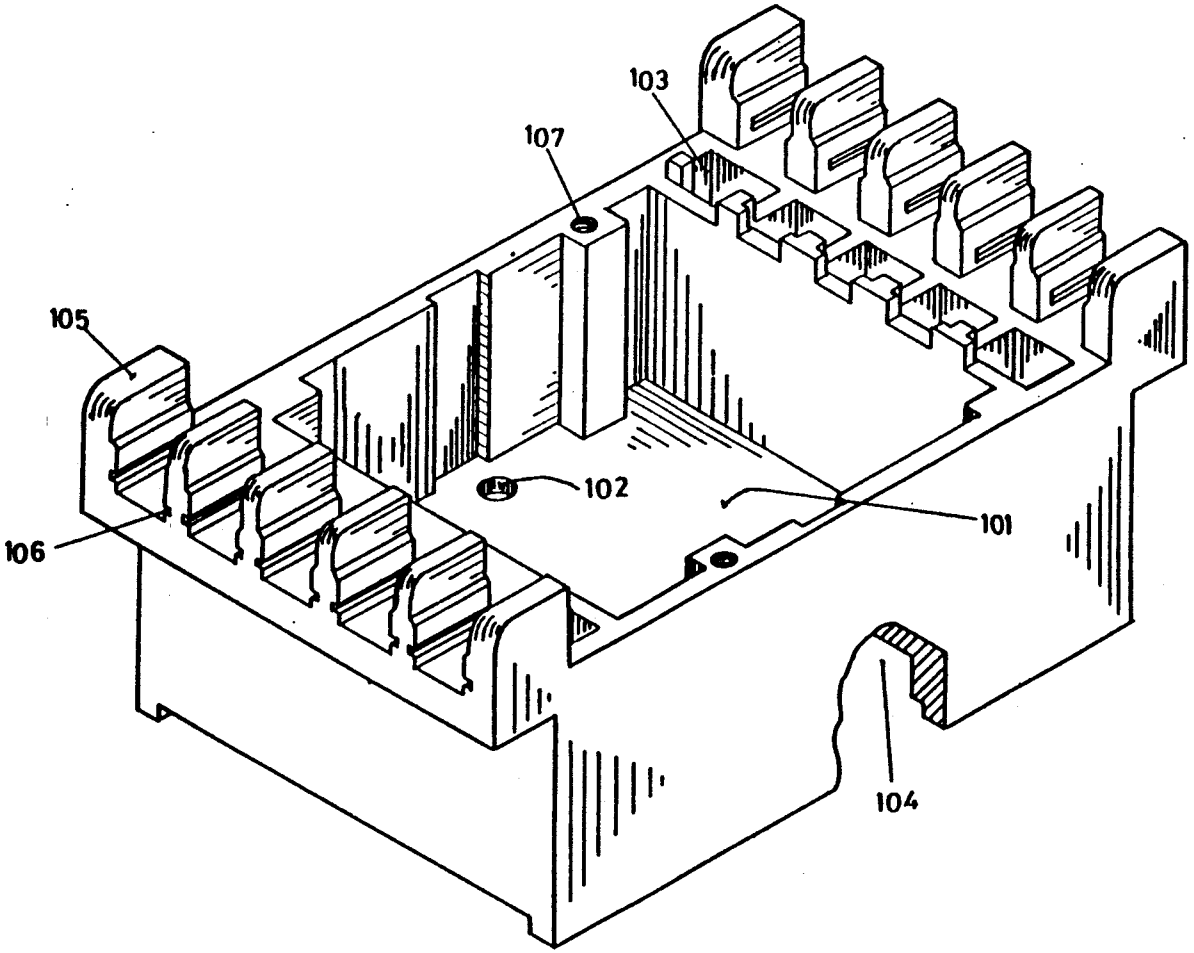
FIG. 6 is a three-dimensional perspective view of the main casing of the present invention.

The contact points 47 are separately provided at two ends of each elastic strip conductors 43. On top edges of two opposite sides of the main casing 10 corresponding to the contact points 47, a plurality fixed strip conductors 84 and fixed contact points 85 equal in number to the number of contact points 47 is provided, the contact point 85 being located on the fixed strip conductors 84 to form either a closed circuit depending on the position of the seesaw or an open circuit. One part of the middle section of the insulation seat 42 of FIG. 3 is upwardly projected and separates an elastic strip conductor 44 and an elastic strip conductor 45 disposed at two sides of the insulation seat 42. An insulated flexiable wire attached on one end of the elastic strip conductor 44 is connected to the conductor of coil 33 of the exciter set 30, while the other end of elastic strip conductor 44 is provided with a contact point 47 which corresponds to the fixed strip conductor 84 on the sides of the main casing 10 and may contact the fixed contact point 85 at an inner end of the fixed strip conductor 84 to form a closed circuit. Similarly, the elastic strip conductor 45 may form another closed circuit with the fixed strip conductor 84 at the other side of the main casing 10, so that an interlocked circuit is formed. A generally square column is provided at a proper position on the insulation seat 42 to allow it to pass an opening formed in the upper casing 60 and project out of the upper casing 60. Whenever it is necessary to test or repair the circuit, the square column may be pulled out or pushed down to test the circuit. A plurality of side openings 103 are formed on the main casing 10 at its two opposite ends between the outer wall of the main casing 10 and the inner wall which form the inner casing 101. These side openings together with bottom space 104 between the bottoms of the main casing 10 and of the inner casing 101 permit various switch conductors 86 to pass through and connect to the fixed strip conductors 84 separately located at two opposite sides of the main casing 10 above each side opening 103, so that a forward circuit and a reverse circuit may be formed. Each of these fixed strip conductors 84 is fixedly received in a pair of indented grooves 106 formed near the bottom portion of a plurality of projections 105 provided at two opposite sides of the main casing 10. A soleplate 50 is fixed to the main casing 10 below the bottom space 104 to protect conductors 86 from damage due to exposure to outside of the main casing 10.

An upper casing 60 covers the seesaw assembly 40 and may be fastened to the main casing 10 by screws 87 screwed into threaded holes 107 formed on the main casing 10. A plurality of openings are formed on the upper casing 60 to allow the flexible conductors 46 connected to the elastic strip conductors 43 in the seesaw assembly 40 to pass therethrough and connected to the terminals provided on top of the upper casing 60. Additional terminals may be provided on the top of the upper casing 60 for connecting other electrical appliances, thus simplifying wiring procedures while significantly reducing the entire volume of the electromagnetic switch a transparent top cover 70 may be further covered above the upper casing 60 to protect terminals thereon. A plurality of round bars are formed at the underside of the top cover 70 and are capable of fitly inserted into a plurality of corresponding round holes formed on top of the upper casing 60. A plurality of conductor holes are formed on the top cover 70 at the portion nearby the terminals permitting the conductors to pass therethrough.

Figure 7:
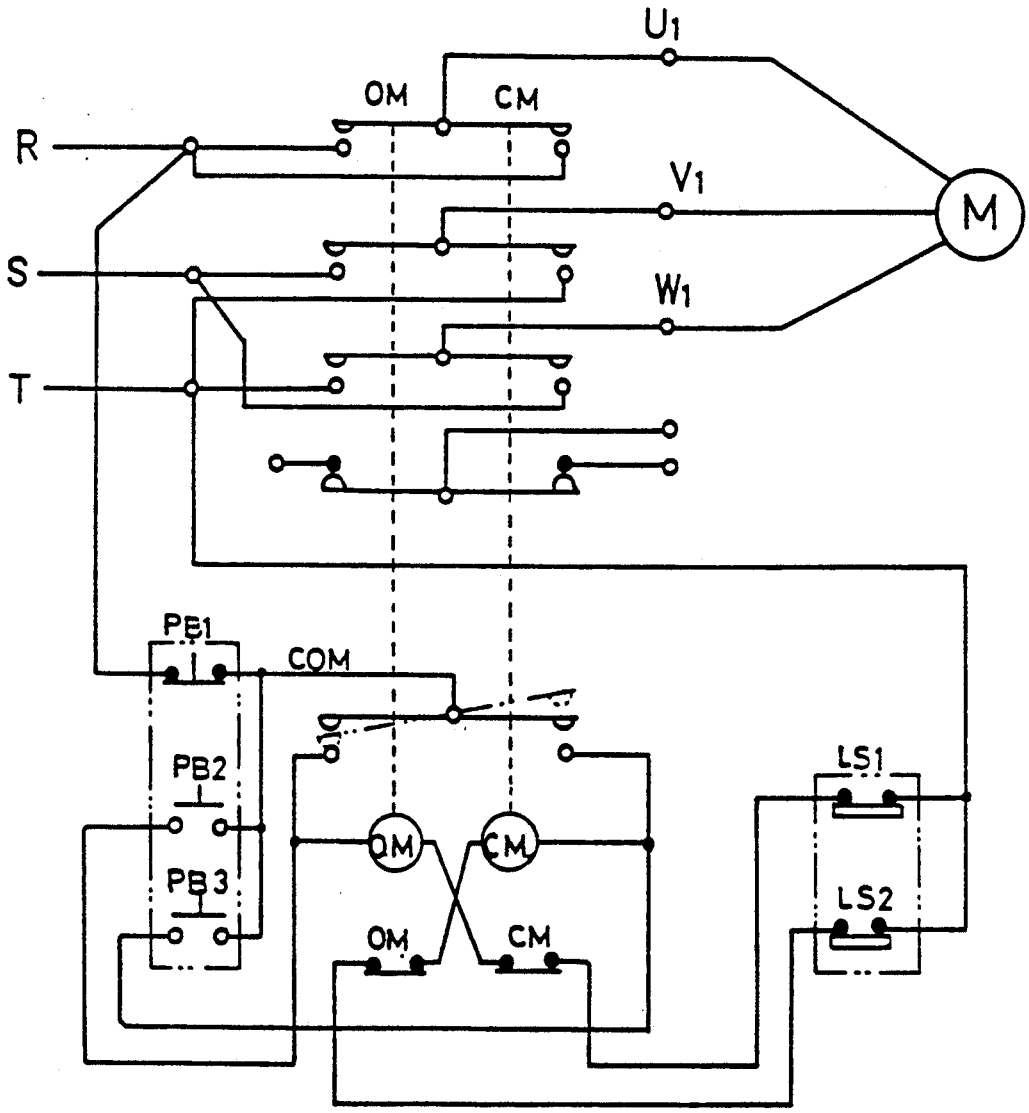
FIG. 7 is a circuit diagram for a preferred embodiment of the present invention.
Figure 8A:
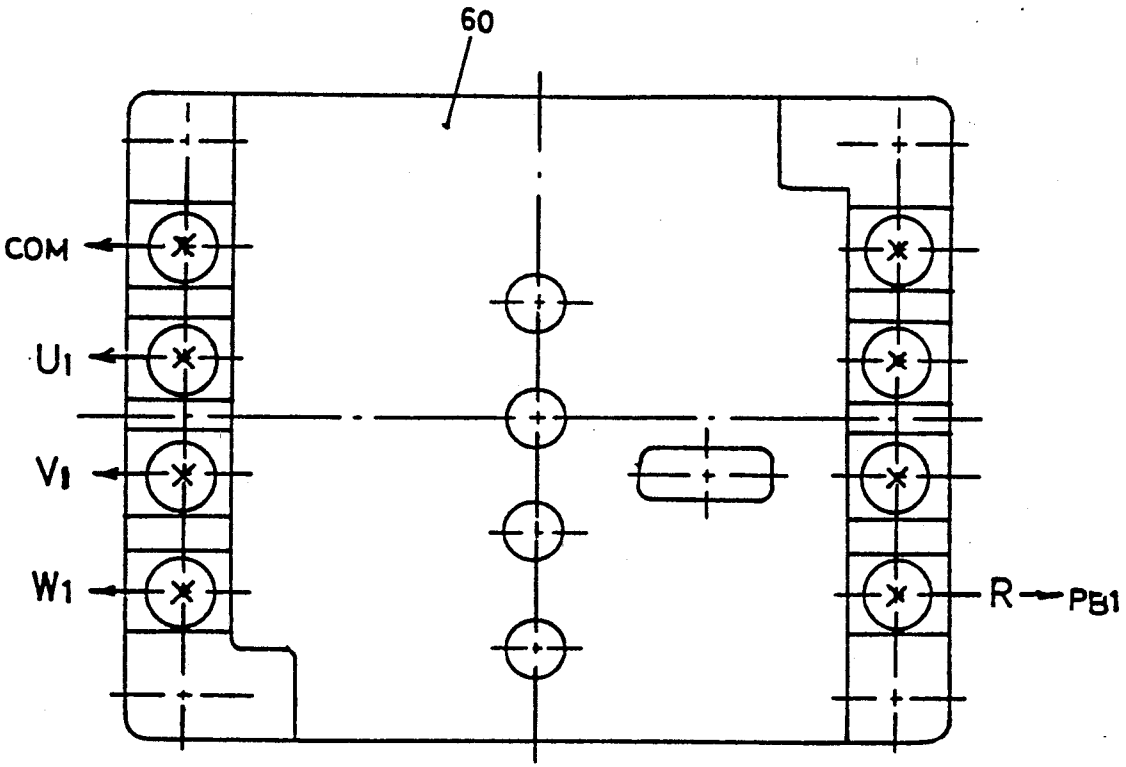
FIGS. 8*a* and 8*b* are wiring diagrams for a preferred embodiment of the present invention.
Figure 8B:
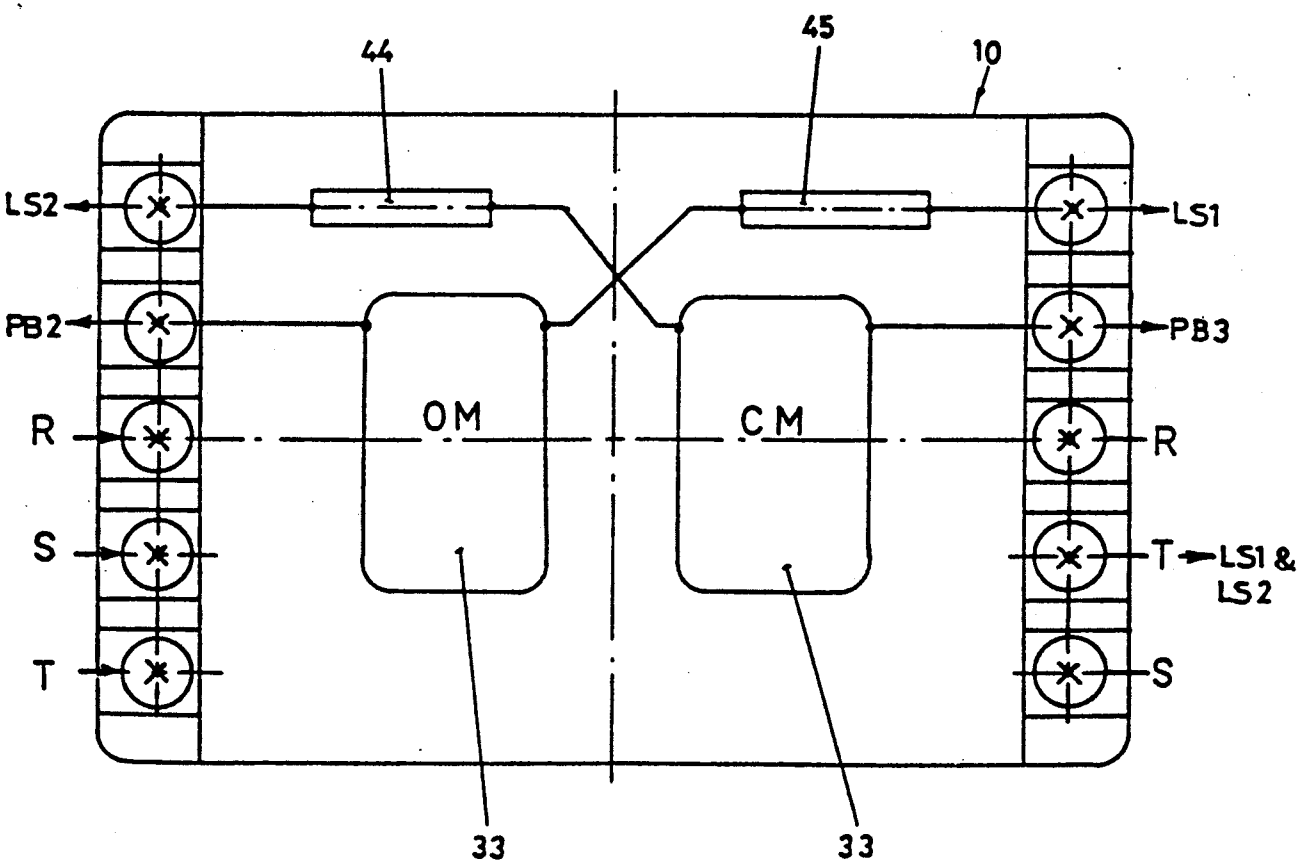
Figure 9:
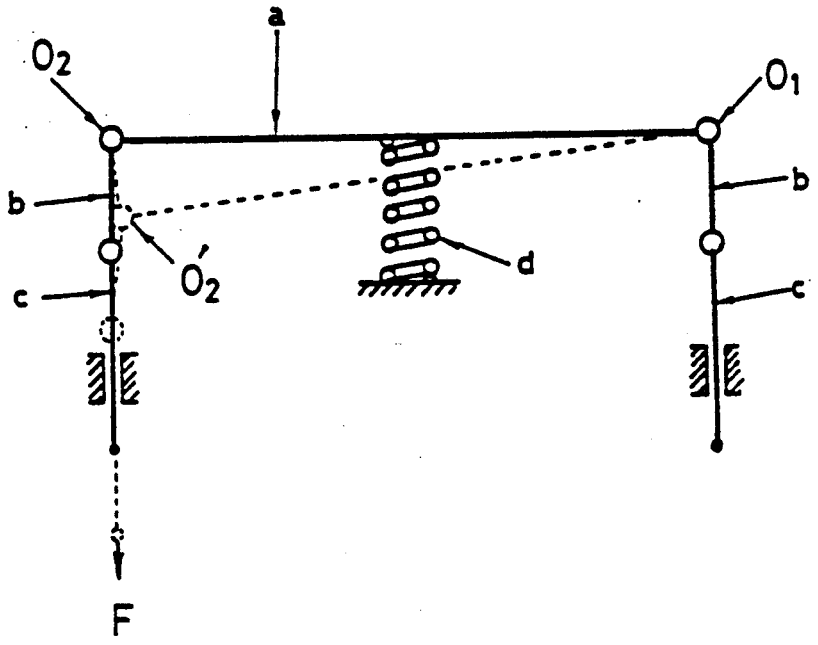
FIG. 9 PRIOR ART
FIG. 9 is an analytical drawing illustrating the mechanism of conventional electromagnetic contactors.

Turning to FIGS. 7 and 8, which should be viewed together with FIGS. 1 thru 6. When a Forward Rotation Push-button Switch PB2 is pressed, an electic current flows through one of the coils 33 of the exciter set 30 and makes the fixed iron core 32 in the coil holder 31 generate magnetic force to attract the iron-made seesaw 41 of the seesaw assembly 40. At this point, the seesaw 41 swings toward one side with the fixed pivot 82 as its fulcrum and the contact points 47 on that side of the seesaw assembly 40 contact the fixed contact points 85 on the fixed strip conductors 84 at the corresponding side of the main casing 10 to form a closed circuit. Current from a power source flows through the fixed strip conductors 84, fixed contact points 85, contact points 47, the elastic strip conductors 43, the flexible conductors 46, and reaches the motor in use, energizing the same to rotate in a forward direction. At this point, the other end of the seesaw assembly 40 is lifted and the contact points 47 on that side form an open circuit while, a close circuit is still formed by the elastic strip conductor 45 on the lifted side. Therefore, and interlocked circuit is formed when the circuit at the side of the elastic strip conductor 44 is disconnected. Conversely, when a Reverse Rotation Push-buttom Switch PB3 is pressed, with the same principle, current from the power source flows through the fixed strip conductors 84, the switch conductors 86, fixed strip conductors 84 on the other side, the fixed contact points 85 thereon, the corresponding contact points 47, the elastic strip conductors 43, the flexible conductors 46, and reaches the motor in use, emergying the same to rotate in reverse direction. In the case of conventional forward-/reverse current electromagnetic switch controlled motors, any movable contact point might be stuck to the fixed contact point in either a forward or a reverse circuit when the motors have been used for a period of time or when larger capacity motors are used to generate larger current. If the circuit is switched at this point, a short-circuit will occur and burn out the electromagnetic switch. In contrast, when the inventive seesaw type interlocked forward reverse current electromagnetic switch of the present invention is used, even if its forward rotation button and its reverse rotation button are incidently pressed at the same time by an operator or a child and causes current to simultaneously flow through two coils 33 in the exciter set 30 and make the iron cores 32 generate opposing forces to move the seesaw assembly 40, or even if any one of the contact points is stuck in any rotation circuit, no short-circuit would occur in either of the forward rotation or reverse rotation circuits because movement of the seesaw assembly 40 is confined by the fixed pivot 82 and thereby cuts off current to the motor's circuit. Under the circumstances, the motor in use is protected from being damage and the operator is protected from any injury in accidents caused by such damage.

I claim:

1. A seesaw mechanically interlocked electromagnetic switch to controlling a forward/reverse current system, comprising:

a main casing, an exciter set, a seesaw assembly, a soleplate, an upper casing, and a transparent top cover, said main casing having an inner casing in which a U-shaped seat is fixedly disposed to receive the exciter set, said U-shaped seat including two coil holders arranged in parallel, two round holes separately formed on sidewalls of the U-shaped seat, a fixed pivot supported in the two round holes, said fixed pivot supporting said seesaw assembly and permitting the same to swing around said fixed pivot;

a plurality of side openings formed between said inner casing and outer walls of said main casing at two opposite sides of said main casing, and a bottom space formed between said inner casing and a bottom of said main casing, said side openings forming means for permitting conductors to pass therethrough; and a plurality of fixed strip conductors disposed in said side openings with fixed contact points provided at inner ends of each of said fixed strip conductors, said seesaw assembly including a plurality of elastic strip conductor, and a plurality of contact points provided on two ends of each of said elastic strip conductors at a position corresponding to said fixed contact points on said fixed strip conductors to permit formation of closed or open circuits; and two springs disposed under two ends of said seesaw assembly, said springs being positioned between said seesaw assembly and said exciter set to balance said seesaw assembly and form an interlocked forward/reverse current electromagnetic switch, wherein said soleplate fixedly joined to a bottom of said main casing to allow various conductors to pass through a bottom of said main casing without being damaged to exposure to the outside of said main casing, said upper casing covers said seesaw assembly and is secured to said main casing with screws, a plurality of openings are formed on a top of said upper casing allowing flexible conductors connected at one end of said elastic strip conductors to pass through said upper casing and be connected at their other ends to terminals provided on top of said upper casing, a transparent top cover covers said upper casing to protect the terminals thereon and has a plurality of round holes formed therein to permit round bars on said upper casing to be inserted into said round holes so that said transparent top cover is securely joined to said upper casing, and said top cover also has a plurality of conductor holes formed at a position nearby the outside of said terminal on said upper casing to allow conductors to pass therethrough.

2. A seesaw electromagnetic switch as claimed in claim 1, further comprising a generally square column provided on said seesaw assembly such that an upper end of the column passes through a hole formed on said upper casing and projects out of said upper casing for testing a circuit during checking or repairing the circuit by pulling outward or pushing downward on said square column.

3. A seesaw electromagnetic switch as claimed in claim 1, wherein said seesaw assembly has an insulation seat, part of a middle portion of said insulation seat projecting upwardly to separate a first elastic strip conductor from a second elastic strip conductor, said second elastic strip conductor being disposed at an opposite side of said insulation seat first elastic strip conductor, one end of said first elastic conductor being connected to a conductor of a coil in said exciter set, the other end of said elastic strip conductor having a contact point corresponding to a contact point on one of said fixed strip conductors on said main casing, wherein a closed circuit is maintained by contact between said contact point on said first elastic strip conductor and said contact point on said fixed strip conductor of said main casing, and wherein, conversely, another closed circuit may be formed by contact between said second elastic strip conductor and a contact point on a second fixed strip conductor on said main casing, thereby forming a chain circuit.

4. A seesaw electromagnetic switch as claimed in claim 1, wherein said upper casing includes multiple terminals for connecting a plurality of electrical appliances thereto, thereby simplifying wiring and reducing the volume of said electromagnetic switch.

* * * * *